US010350598B2

(12) United States Patent
Schwemmer et al.

(10) Patent No.: US 10,350,598 B2
(45) Date of Patent: Jul. 16, 2019

(54) FLUIDIC MODULE, DEVICE AND METHOD FOR HANDLING LIQUID

(71) Applicant: Hahn-Schickard-Gesellschaft fuer angewandte Forschung e.V., Villingen-Schwenningen (DE)

(72) Inventors: Frank Schwemmer, Freiburg (DE); Steffen Zehnle, Freiburg (DE); Nils Paust, Freiburg (DE); Daniel Mark, Freiburg (DE)

(73) Assignee: HAHN-SCHICKARD-GESELLSCHAFT FUER ANGEWANDTE FORSCHUNG E.V., Villingen-Schwenningen (DE)

( * ) Notice: Subject to any disclaimer, the term of this patent is extended or adjusted under 35 U.S.C. 154(b) by 155 days.

(21) Appl. No.: 15/368,714

(22) Filed: Dec. 5, 2016

(65) Prior Publication Data

US 2017/0216837 A1 Aug. 3, 2017

Related U.S. Application Data

(63) Continuation of application No. PCT/EP2015/062956, filed on Jun. 10, 2015.

(30) Foreign Application Priority Data

Jun. 11, 2014 (DE) ..... 10 2014 211 121

(51) Int. Cl.
*B01L 3/00* (2006.01)

(52) U.S. Cl.
CPC ..... *B01L 3/50273* (2013.01); *B01L 3/502746* (2013.01); *B01L 2200/0621* (2013.01);
(Continued)

(58) Field of Classification Search
CPC ..... B01L 2400/0409; B01L 2300/087; B01L 2300/0803; B01L 2300/0806;
(Continued)

(56) References Cited

U.S. PATENT DOCUMENTS

2014/0109972 A1* 4/2014 Garcia Da Fonseca ..... B01L 3/502738 137/1

FOREIGN PATENT DOCUMENTS

DE 10 2009 050 979 A1 5/2011
DE 10 2012 202 775 A1 8/2013
(Continued)

OTHER PUBLICATIONS

Official Communication issued in International Patent Application No. PCT/EP2015/062956, dated Oct. 1, 2015.
(Continued)

*Primary Examiner* — Christopher Adam Hixson
(74) *Attorney, Agent, or Firm* — Keating & Bennett, LLP

(57) ABSTRACT

A fluidic module rotatable about a center of rotation includes a first compression chamber having a fluid inlet and a fluid outlet, a second compression chamber having a fluid inlet, a first fluid channel connected to the first chamber via the fluid inlet of the first chamber, and a second fluid channel connecting the fluid outlet of the first chamber to the fluid inlet of the second chamber. Due to rotation of the fluidic module a liquid may be centrifugally driven into the first chamber and the second fluid channel through the first fluid channel, and thereby a compressible medium may be entrapped and compressed within the second chamber. By lowering the rotary frequency and due to the resultant expansion of the compressible medium, liquid may be driven out of the second fluid channel into the first chamber, out of the first chamber into and through an outlet channel.

12 Claims, 5 Drawing Sheets

(52) U.S. Cl.
CPC ..... *B01L 2200/0684* (2013.01); *B01L 2300/0803* (2013.01); *B01L 2300/087* (2013.01); *B01L 2400/0409* (2013.01); *B01L 2400/084* (2013.01)

(58) Field of Classification Search
CPC ..... B01L 2200/0621; B01L 3/50273; B01L 3/502746
See application file for complete search history.

(56) References Cited

FOREIGN PATENT DOCUMENTS

| | | |
|---|---|---|
| DE | 10 2013 210 818 B3 | 5/2014 |
| DE | 10 2013 203 293 A1 | 8/2014 |
| DE | 10 2013 215 002 B3 | 11/2014 |

OTHER PUBLICATIONS

Gorkin III et al., "Pneumatic pumping in centrifugal microfluidic platforms", Microfluid Nanofluid, vol. 9, No. 2-3, Feb. 17, 2010, pp. 541-549.
Zehnle et al., "Centrifugo-dynamic inward pumping of liquids on a centrifugal microfluidic platform", Lab Chip, vol. 12, pp. 5142-5145.

* cited by examiner

FLUIDIC MODULE, DEVICE AND METHOD FOR HANDLING LIQUID

CROSS-REFERENCE TO RELATED APPLICATIONS

This application is a continuation of copending International Application No. PCT/EP2015/062956, filed Jun. 10, 2015, which is incorporated herein by reference in its entirety, and additionally claims priority from German Application No. 10 2014 211121.8, filed Jun. 11, 2014, which is also incorporated herein by reference in its entirety.

The present invention relates to a fluidic module, a device and a method for handling liquid which are suitable, in particular, for handling—e.g. retaining and releasing and/or pumping—liquid within a centrifugal-microfluidic system.

BACKGROUND OF THE INVENTION

Centrifugal microfluidics deals with handling of liquids within the pl to ml ranges in rotating systems. Such systems are mostly disposable polymer cartridges used in or instead of centrifuge rotors, with the intention of enabling completely novel processes which cannot be performed by manual processes or pipetting robots because of the precision or volume involved, or of automating laboratory processes. In this context, standard laboratory processes such as pipetting, centrifuging, mixing or aliquoting may be implemented in a microfluidic cartridge. To this end, the cartridges contain channels for directing fluids as well as chambers for collecting liquids. The cartridges are subject to a predefined sequence of rotary frequencies, the frequency protocol, so that the liquids contained within the cartridges may be directed into corresponding chambers by inertial forces. Centrifugal microfluidics is mainly applied in laboratory analytics and in mobile diagnostics.

The implementation of cartridges that has been most common up to now are centrifugal-microfluidic disks which are known, e.g., by the names or brands of "Lab-on-a-disk", "Lab-Disk" and "Lab-on-CD", which are inserted into specific processing equipment. Other formats such as a microfluidic centrifuge tube, which is known by the name of "LabTube", may be inserted into rotors of already existing standard laboratory equipment.

One essential fundamental operation that is performed in centrifugal-microfluidic cartridges is retaining and releasing liquids in a calculated manner. The problem consists in transferring liquids from a first fluid chamber into a second fluid chamber at defined rotary frequencies or defined changes in the rotary frequencies, and/or in retaining liquids within a first chamber at defined rotary frequencies or defined changes in the rotary frequencies. For using said fundamental operation in a potential product, robustness of the process is paramount. Moreover, the fundamental operation should be implemented as a monolithically integrated valve so that no additional components or materials—which considerably increase the cost of the cartridge in terms of cost of materials or in terms of additional structural design and connection technology (assembly)—are required.

Monolithically integrated valves in centrifugal-microfluidic systems are known from conventional technology. For example, in "Pneumatic Pumping in Centrifugal Microfluidic Platform", Microfluid Nanofluid, 2010, 9, pp. 541 to 549, R. Gorkin et al. describe a method of pneumatic pumping which enables retaining liquid within a first fluid chamber during a first phase at defined, high rotary frequencies (typically several 10 Hz) and to subsequently direct the liquid into a second fluid chamber during a second phase at defined, lower rotary frequencies. This involves transferring liquid from a reservoir into a first fluid chamber when the rotary frequency increases. When the rotary frequency increases, the liquid is retained within the first fluid chamber, a gas volume entrapped within the first fluid chamber being compressed. When the rotary frequency decreases, the entrapped gas volume expands again and displaces some of the liquid into a curved channel acting as a siphon. Once the siphon crest has been passed, an additional centrifugal pressure arises which causes the liquid to be transferred from the first into the second fluid chamber. Thus, a gas volume within the first fluid chamber that is entrapped by the process liquid is compressed during the first phase so as to make use, during the second phase, of the corresponding expansion of the gas volume for returning the liquid.

In the process of pneumatic pumping, a specific threshold value of the rotary frequency (threshold frequency) will be exceeded during the first phase so as to retain the liquid within the first fluid chamber. This very threshold frequency will subsequently be fallen below so as to return the liquid via the siphon crest and to start the transfer of fluid from the first fluid chamber into the second fluid chamber. In order for the filling of the siphon to be independent of capillary forces, the threshold frequency should be as high as possible.

S. Zehnle, F. Schwemmer, G. Roth, F. von Stetten, R. Zengerle and N. Paust, "Centrifugo-dynamic Inward Pumping of Liquids on a Centrifugal Microfluidic Platform", Lab Chip, 2012, 12, pp. 5142 to 5145, describe a method of centrifugo-dynamic inward pumping which enables retaining liquid within a first fluid chamber at defined, high rotary frequencies (typically several 10 Hz) during a first phase and to subsequently direct a major part of the liquid into a second, radially inwardly located fluid chamber at a rapidly decreasing rotary frequency during a second phase. This involves transferring liquid from a reservoir into a first fluid chamber when the rotary frequency increases. When the rotary frequency increases, the liquid is retained within the first fluid chamber, a gas volume entrapped within the first fluid chamber being compressed. When the rotary frequency rapidly decreases, the entrapped gas volume expands again and displaces the major part of the liquid through that channel which has the smaller flow resistance. Thus, a gas volume within the first chamber that is entrapped by the process liquid is compressed during the first phase so as to make use, during the second phase, of the energy of the compressed gas for pumping the liquid radially inward. A corresponding method is described in DE 10 2012 202 775 A1.

As was set forth above, the threshold frequency should be as high as possible in pneumatic pumping so as to keep the influence of capillary forces low. This means that the siphon is typically also filled at high rotary frequencies (even if the delay rate amounts to several 10 Hz/s). The inventors have found that this has drawbacks. When the liquid reaches the siphon crest at relatively high rotary frequencies, this may cause instability of the liquid/gas interface at the siphon crest. Inclusion of air bubbles and, thus, function failure of the siphon may result. This effect might be minimized in a siphon having a small cross-sectional area, which would increase, however, the dependency on capillary forces as well as the fluidic resistance and, thus, the length of time during which the fluid transfer takes place. When liquid is pumped through a siphon at relatively high rotary frequencies, instability of the liquid/gas interface at the outer siphon end may also result. Here, too, inclusion of air bubbles and, thus, function failure of the siphon may be the consequence.

Depending on the configuration of the siphon, the pressure in the siphon crest may become so low, in case of a high rotary frequency, that the liquid will evaporate and that consequently, formation of gas bubbles will result in a function failure of the siphon. Even at relatively low rotary frequencies and, thus, relatively low negative pressures, gas bubbles may form since, due to the relatively low pressure within the crest area of the siphon, the solubility of gases such as oxygen, for example, will decrease and consequently, the amount of gas which is no longer soluble will outgas in the form of bubbles.

If inward pumping as is described, e.g., in DE 10 2012 202 775 A1 is used as a function of a valve, this is disadvantageous in that it will never be the entire volume of liquid that will be transferred from the compression chamber into the collection chamber.

A further possibility of retaining liquids is to exploit capillary force which, controlled by the rotary frequency, is overcome by the centrifugal force in order to move the liquid. However, such methods are highly dependent on the surface tension of the liquid and on the nature of the surfaces of the fluidic channels and can therefore not be considered to be robust.

SUMMARY

According to an embodiment, a fluidic module which may be rotated about a center of rotation may have: a first compression chamber having a fluid inlet and a fluid outlet; a second compression chamber having a fluid inlet; a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein at least one of the following features is met: the second fluid channel has a flow resistance for the liquid that is larger than that of the outlet channel, and the fluid inlet of the second compression chamber is arranged, in relation to the center of rotation, radially further outward than is the fluid outlet of the first compression chamber.

According to another embodiment, a device for handling liquid may have: a fluidic module which may be rotated about a center of rotation, which fluidic module may have: a first compression chamber having a fluid inlet and a fluid outlet; a second compression chamber having a fluid inlet; a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein at least one of the following features is met: the second fluid channel has a flow resistance for the liquid that is larger than that of the outlet channel, and the fluid inlet of the second compression chamber is arranged, in relation to the center of rotation, radially further outward than is the fluid outlet of the first compression chamber; and a drive device configured to subject the fluidic module to rotations at different rotary frequencies, the drive device being configured to subject the fluidic module, during a first phase, to a rotation at a rotary frequency at or above a first rotary frequency at which liquid is centrifugally driven through the first fluid channel into the first compression chamber, at which the first compression chamber is filled with the liquid and at which liquid is driven out of the first compression chamber into the second fluid channel and into the second compression chamber so as to thereby entrap and compress the compressible medium within the second compression chamber, the drive device being configured to lower, during a second phase following the first phase, the rotary frequency to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second compression chamber and the second fluid channel into the first compression chamber, out of the first compression chamber into the outlet channel and through said outlet channel.

Another embodiment may have a method of handling liquid, having a fluidic module a fluidic module which may be rotated about a center of rotation, which fluidic module may have: a first compression chamber having a fluid inlet and a fluid outlet; a second compression chamber having a fluid inlet; a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein at least one of the following features is met: the second fluid channel has a flow resistance for the liquid that is larger than that of the outlet channel, and the fluid inlet of the second compression chamber is arranged, in relation to the center of rotation, radially further outward than is the fluid outlet of the first compression chamber, which method may have the steps of: during a first phase, rotating the fluidic module with a rotation at a rotary frequency at or above a first rotary frequency so as to centrifugally drive liquid through the first fluid channel into the first compression chamber and into the second compression chamber so as to fill the first compression chamber with the liquid, and to drive liquid from the first compression chamber into the second fluid channel so as to thereby entrap and compress the compressible medium within the second compression chamber, during a second phase following the first phase, lowering the rotary frequency to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second compression chamber and the second fluid channel into the first compression chamber, out of the first compression chamber into the outlet channel and through said outlet channel.

Embodiments of the invention provide a fluidic module which may be rotated about a center of rotation, comprising:

a first compression chamber having a fluid inlet and a fluid outlet;

a second compression chamber having a fluid inlet;

a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber and into the second fluid channel through the first fluid channel, and thereby a compressible medium may be entrapped and compressed within the second compression chamber, wherein, by lowering the rotary frequency and due to the resultant expansion of the compressible medium, liquid may be driven out of the second fluid channel into the first compression chamber, out of the first compression chamber into an outlet channel and through said outlet channel, wherein at least one of the following features is met:

the second fluid channel has a flow resistance larger than that of the outlet channel, and the fluid inlet of the second compression chamber is arranged, in relation to the center of rotation, radially further outward than is the fluid outlet of the first compression chamber.

Embodiments of the invention provide a device for handling, in particular for pumping, liquid, comprising a fluidic module as has been described, and a drive device configured to subject the fluidic module to rotations at different rotary frequencies. The drive device is configured to subject the fluidic module, during a first phase, to a rotation at a rotary frequency at or above a first rotary frequency at which liquid is centrifugally driven through the first fluid channel into the first compression chamber, at which the first compression chamber is filled with the liquid and at which liquid is driven out of the first compression chamber into the second fluid channel so as to thereby entrap and compress the compressible medium within the second compression chamber. The drive device is further configured to lower, during a second phase following the first phase, the rotary frequency to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second fluid channel into the first compression chamber, out of the first compression chamber into the outlet channel and through said outlet channel.

Embodiments of the invention provide a method of handling liquid, comprising a fluidic module as has been described. During a first phase, the fluidic module is rotated at a rotary frequency at or above a first rotary frequency so as to centrifugally drive liquid through the first fluid channel into the first compression chamber so as to fill the first compression chamber with the liquid, and to drive liquid from the first compression chamber into the second fluid channel so as to thereby entrap and compress the compressible medium within the second compression chamber. During a second phase following the first phase, the rotary frequency is lowered to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second fluid channel into the first compression chamber, out of the first compression chamber into the outlet channel and through said outlet channel.

Embodiments of the invention thus relate to fluidic modules, devices and methods which are suitable for releasing liquid in a controlled manner and for directing liquid through a channel in a controlled manner, and in particular to such fluidic modules, devices and methods which are suitable for time-switched pumping of a liquid within centrifuge rotors.

Embodiments of the invention are based on the finding that by providing a first compression chamber, a second compression chamber and a second fluid channel fluidically connecting the first and second compression chambers and by configuring the course and the dimensions of the second fluid channel accordingly it is possible to passively control the dynamics of the pumping operation through the outlet channel during and following the reduction in the rotary frequency, i.e., to control said dynamics without changing the rotary frequency any further.

In embodiments of the invention, the second fluid channel may thus comprise a flow resistance larger than that of the outlet channel. For example, the cross-section of the second fluid channel may be sufficiently small to provide a flow resistance for the liquid that is larger than the flow resistance of the outlet channel. The viscosity of the liquid (e.g., water) may be significantly higher than the viscosity of the compressible medium (e.g., air). Thus, embodiments of the invention enable, due to the higher viscosity of the liquid, a delay in the pumping operation through the outlet channel as long as the second fluid channel is filled with liquid. It is not before the second fluid channel is partly or fully filled with the low-viscosity compressible medium that the pumping operation through the outlet channel takes place at a clearly higher flow rate which is not limited by the flow resistance present within the second fluid channel. Due to the delay in the pumping operation, the liquid may thus be directed through the outlet channel at any rotary frequency, in particular also during standstill.

In embodiments of the invention, the end of the second fluid channel may be located radially further outward than the beginning of the second fluid channel, so that an expansion of the compressible medium within the second compression chamber and within the second fluid channel results in that, when the second fluid channel is pumped empty, the centrifugal counterpressure acting on the expanding compressible medium decreases significantly on account of this course of the second fluid channel. However, this decrease in the centrifugal counterpressure is caused by only a relatively small change in the volume of the compressible medium, which means that the overpressure, which remains almost constant, of the compressible medium is up against a significant change in the centrifugal counterpressure. Said pressure change is balanced off in that the liquid within the first compression chamber is pumped into the outlet channel at a high flow rate. Thus, embodiments of the invention enable high dynamics when the liquid is emptied out of the first compression chamber. Due to the pronounced change in the centrifugal counterpressure during emptying but also during filling of the second fluid channel, it is not only the dynamics of the operation of emptying the first compression chamber or the dynamics of filling the second compression chamber that is influenced, but also the rotary frequency at which—assuming that the liquid filling levels are in balance—emptying of the first compression chamber takes place. Thus, embodiments of the invention enable the switching frequencies to be adjusted on account of the different radial positions of the fluid outlet of the first compression chamber and of the fluid inlet of the second compression chamber.

In embodiments of the invention, the outlet channel may at least partly be formed by the first fluid channel. Thus, in embodiments of the invention, the first channel is the outlet channel. In alternative embodiments of the invention, the outlet channel comprises part of the first fluid channel as well as a third fluid channel branching off from the first fluid channel. In alternative embodiments, the outlet channel is a fluid channel which is separate from the first fluid channel and which leads into the first compression chamber at a radially outer portion or at the radially outer end thereof. In embodiments, the outlet channel has a flow resistance lower than that of the first fluid channel. In embodiments, the outlet channel comprises a siphon, an outlet end of which is arranged radially further outward, in relation to the center of rotation, than is the position where the outlet channel leads into the first compression chamber.

Embodiments of the invention represent centrifugal-pneumatic delay switches. In embodiments of the invention, a delay of emptying of a first compression chamber takes place initially, whereupon emptying may dynamically take place without involving any further change in the rotary frequency. These effects may be achieved either by means of the course of the second fluid channel (connecting channel) within the centrifugal field of force or by means of the larger flow resistance of the second fluid channel in relation to the outlet channel, or by means of both.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
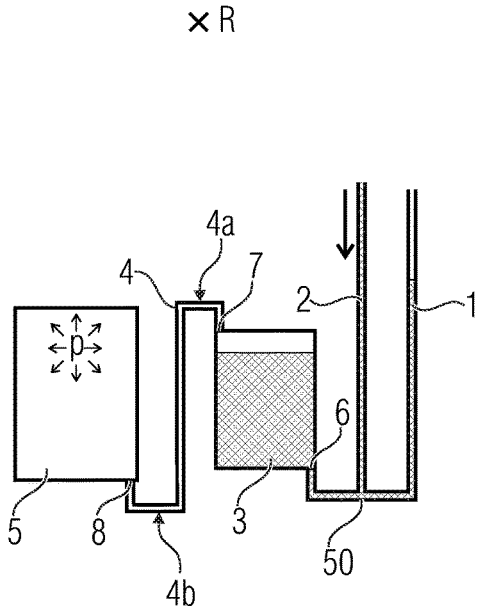
FIGS. 1A to 1D show schematic top views of fluidic structures of an embodiment of a fluidic module, one fluid inlet of the second compression chamber being arranged radially further outward than is a fluid outlet of the first compression chamber.

Before embodiments of the invention will be explained in more detail, it shall initially be noted that examples of the invention may be applied, in particular, in the field of centrifugal microfluidics, which is about processing liquids within the picoliter to milliliter ranges. Accordingly, the fluidic structures may have suitable dimensions within the micrometer range for handling corresponding volumes of liquid. In particular, embodiments of the invention may be applied in centrifugal-microfluidic systems as are known, for example, by the name of "Lab-on-a-Disk".

Whenever the expression radial is used herein, what is meant in each case is radial in relation to the center of rotation about which the fluidic module, or the rotor, can be rotated. In the centrifugal field, a radial direction away from the center of rotation is radially descending, and a radial direction toward the center of rotation is radially ascending. A fluid channel whose beginning is located closer to the center of rotation than is its end is therefore radially descending, whereas a fluid channel whose beginning is located further away from the center of rotation than is its end is radially ascending. A channel comprising a radially ascending portion thus comprises directional components which radially ascend and/or extend radially inward. It is clear that such a channel need not extend exactly along a radial line but may extend at an angle to the radial line or in a curved manner.

Herein, a compression chamber is understood to mean a chamber enabling compression of a compressible medium. In embodiments of the present invention, this may be a non-vented chamber. In embodiments, this may be a chamber which does comprise venting, which venting however comprises such a large flow resistance for the compressible medium that due to a liquid flowing in, the compressible medium is compressed nevertheless and that the pressure reduction which occurs in the compression chamber (within the relevant time period) due to such venting is negligible. As such, the first and second compression chambers described herein might also be considered to be one compression chamber having two areas connected via the second fluid channel. In embodiments, the compression chambers do not comprise any further fluid openings apart from the inlets and outlets described. In alternative embodiments, the compression chambers may be coupled to additional compression volumes via one or more optional additional channels. In yet alternative embodiments, one or more compression chambers may each comprise a closable venting opening.

Generally, in embodiments of the invention, different flow resistances (hydraulic resistances) of respective fluid channels may be achieved via different flow cross-sections. In alternative embodiments, different flow resistances may also be achieved by other means, for example different channel lengths, obstacles integrated into the channels, and the like. Whenever mention is made herein of a fluid channel, what is meant is a structure whose length dimension from a fluid inlet to a fluid outlet is larger, for example more than 5 times or more than 10 times larger, than the dimension or dimensions defining the flow cross-section. Thus, a fluid channel has a flow resistance for having fluid flow through it from the fluid inlet to the fluid outlet. By contrast, a fluid chamber herein is a chamber which comprises dimensions such that a relevant flow resistance within said chamber does not occur.

Figure 6:
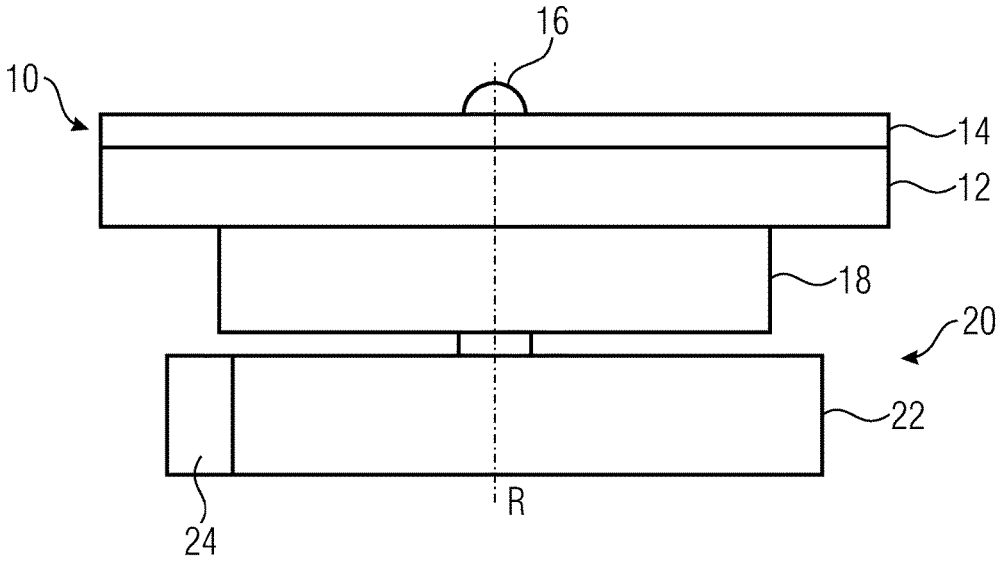
FIGS. 6 and 7 show schematic side views for illustrating embodiments of devices for handling liquid.
Figure 7:
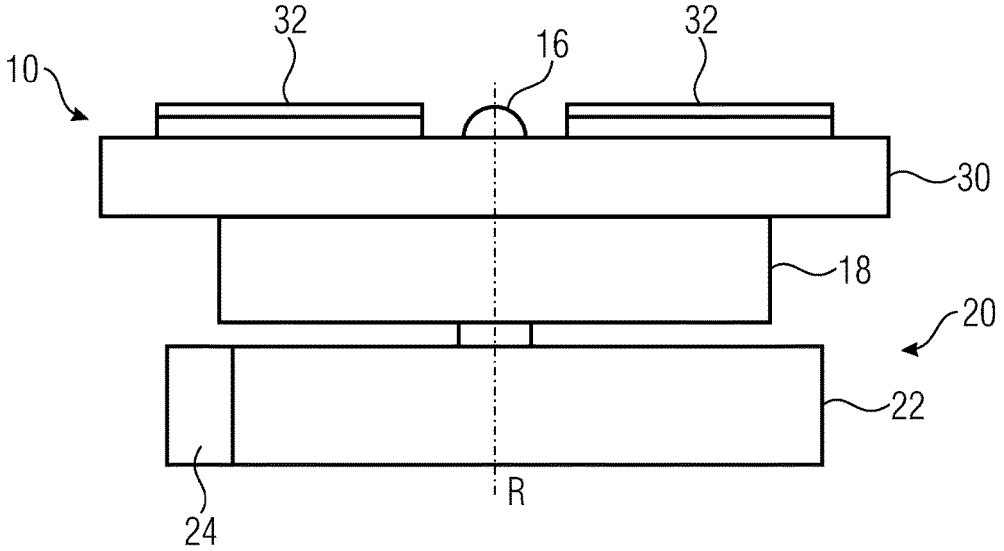

With reference to FIGS. 6 and 7, examples of centrifugal-microfluidic systems wherein the invention may be used will initially be described.

FIG. 6 shows a device comprising a fluidic module 10 in the form of a body of rotation comprising a substrate 12 and a lid 14. The substrate 12 and the lid 14 may be circular in a top view and have a central opening via which the body of rotation 10 may be mounted to a rotating part 18 of a drive device 20 via common attachment means 16. The rotating part 18 is pivoted on a stationary part 22 of the drive device 20. The drive device 20 may be a conventional centrifuge having an adjustable rotational speed, or a CD or DVD drive. Control means may be provided which is configured to control the drive device 20 so as to subject the body of rotation 10 to rotations at different rotary frequencies. As is obvious to any person skilled in the art, the control means 24 may be implemented, e.g., by a computing means programed accordingly or by an application-specific integrated circuit. The control means 24 may further be configured to control the drive device 20, upon manual inputs on the part of a user, to effect the useful rotations of the body of rotation. In any case, the control means 24 may be configured to control the drive device 20 to subject the body of rotation to the rotary frequencies that may be used to implement embodiments of the invention as are described herein. As the drive device 20, a conventional centrifuge with only one direction of rotation may be used.

The body of rotation 10 comprises the fluidic structures that may be used. The fluidic structures that may be used may be formed by cavities and channels in the lid 14, in the substrate 12 or in the substrate 12 as well as in the lid 14. In embodiments, fluidic structures may be formed in the substrate 12, for example, whereas fill-in openings and venting openings are formed in the lid 14. In embodiments, the structured substrate (including fill-in openings and venting openings) is arranged at the top, and the lid is arranged at the bottom.

In an alternative embodiment shown in FIG. 7, fluidic modules 32 are inserted into a rotor 30, and along with said rotor 30 they form the body of rotation 10. The fluidic modules 32 may each comprise a substrate and a lid wherein corresponding fluidic structures may be formed in turn. The body of rotation 10 formed by the rotor 30 and the fluidic modules 32 again may be subject to a rotation by a drive device 20 controlled by the control means 24.

In FIGS. 6 and 7, a center of rotation about which the fluidic module and/or the body of rotation can be rotated is referred to by R.

In embodiments of the invention, the fluidic module and/or the body or rotation comprising the fluidic structures may be formed of any suitable material, for example a plastic such as PMMA (polymethyl methacrylate), PC (polycarbonate), PVC (polyvinyl chloride) or PDMS (polydimethyl siloxane), glass or the like. The body of rotation 10 may be regarded as a centrifugal-microfluidic platform.

In the following, an embodiment of a fluidic module having corresponding fluidic structures will be described with reference to FIGS. 1A to 1D; FIGS. 1A to 1D show those fluidic structures which are formed in a corresponding fluidic module during different operating phases.

The fluidic structures comprise a first fluid channel 2 representing an inlet channel, a first compression chamber 3 and a second compression chamber 5, which are connected to each other via a second fluid channel 4, as well as a third fluid channel 1 representing part of an outlet channel. Specifically, in the example shown in FIGS. 1A to 1D, the third fluid channel 1 branches off from the first fluid channel 2 at a branching 50, so that part of the first fluid channel between the first compression chamber 3 and the branching 50 as well as the third fluid channel represent the outlet channel. The third fluid channel 1 may have a lower flow resistance (therefore, e.g., a larger flow cross-section) than the first fluid channel 2, so that emptying of the first compression chamber 3 is effected largely through the third fluid channel 1.

A fluid inlet 6 of the first compression chamber 3, which in the embodiment is arranged at a radially outer end of the first compression chamber 3, is fluidically connected to the first fluid channel 2 and, thus, also to the third fluid channel 1. A fluid outlet 7 of the first compression chamber 3, which in the embodiment is arranged at a radially inner end of the first compression chamber 3, is fluidically connected to the second fluid channel 4.

A fluid inlet 8 of the second compression chamber 5, which in the embodiment is arranged at a radially outer end of the second compression chamber 5, is fluidically connected to the second fluid channel 4. The fluid inlet 8 of the second compression chamber 5 is located radially further outward than is the fluid outlet 7 of the first compression chamber 3. Thus, a portion of the second fluid channel which is located between the radially innermost portion 4*a* and the radially outermost portion 4*b* of the second fluid channel, extends radially outward in relation to the center of rotation, which is referred to by R in FIG. 1A.

With reference to FIGS. 1A to 1D and to the diagram in FIG. 2, operation of the embodiment of FIGS. 1A to 1D will be explained in detail below.

Phase 1: Filling Process

During operation, a first phase initially comprises partly filling the first compression chamber 3 and the third channel (fluid outlet channel) 1 via the first channel (fluid inlet channel) 2 at a high rotary frequency. For example, a radially inner end of the first fluid inlet channel may be fluidically coupled to an inlet chamber (not shown) for this purpose. This involves entrapping a compressible medium within the first and second compression chambers 3, 5 as well as within the second fluid channel (fluid connection channel) 4, which compressible medium is compressed by the liquid flowing into the first compression chamber, FIG. 1A. In this process, an overpressure builds up within the compressible medium, which overpressure is balanced off by the centrifugal pressure of the liquid present within the fluid inlet channel 2 and within the fluid outlet channel 1. If a rotary frequency $f_1$ is exceeded, the first compression chamber 3 will be filled completely, and the liquid will flow into the second compression chamber 5 via the connection channel 4. After a sufficiently long filling time, the system will reach the state of equilibrium, in which the liquid filling levels will not change anymore at a given rotary frequency. When the rotary frequency decreases, the entrapped compressed compressible medium (gas volume) expands again, and liquid is pumped back through the first fluid channel 2 and the third fluid channel 1.

Phase 2a: Emptying Process with Dynamics Due to Hysteresis Behavior

Figure 1B:
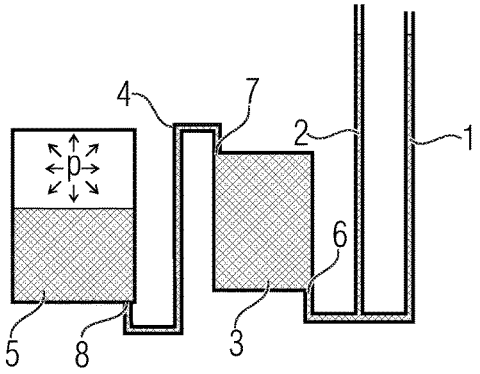
Figure 1C:
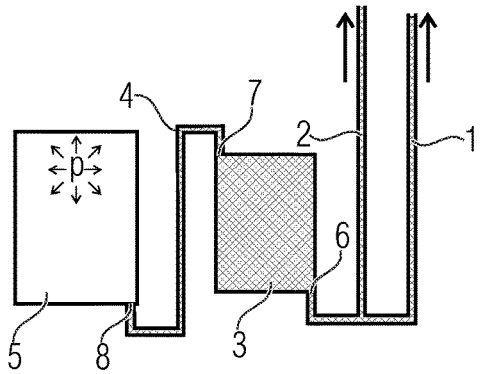
Figure 1D:
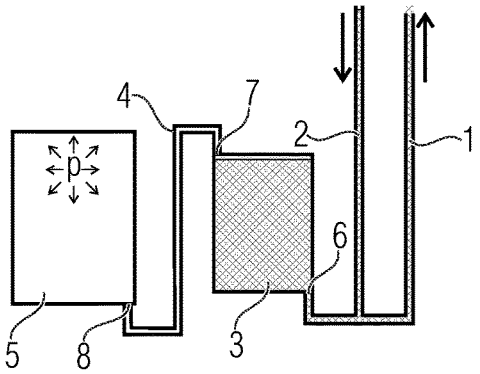

In case the fluid inlet 8 of the second compression chamber 5 is located radially further outward than is the fluid outlet 7 of the first compression chamber 3, as applies in FIGS. 1A to 1D, the system will be off the balance between the centrifugal pressure and pneumatic (in the case of gas being used as the compressible medium) counterpressure of the compressible medium once the rotary frequency $f_1$ is reached. As is shown in FIG. 2, this imbalance is balanced off by rapidly ("dynamically") filling the second compression chamber 5 until the state of equilibrium has been re-attained. FIG. 1B shows the state in the case of a rotation at a frequency higher than the rotary frequency $f_1$.

If the rotary frequency subsequently is reduced again, the second compression chamber 5 will not fully empty itself until the rotary frequency $f_2$ has been reached, wherein $f_2<f_1$. As soon as $f_2$ is fallen below, the connection channel 4 will also empty itself, as a result of which the system will again be off the balance between centrifugal pressure and pneumatic (in the case of gas being used as the compressible medium) counterpressure of the compressible medium. This imbalance is balanced off, in accordance with FIG. 2, by rapidly ("dynamically") emptying the first compression chamber 3 until the state of equilibrium has been re-attained.

This dynamic emptying caused by the pneumatic pressure generates high flow rates within the first fluid channel 2 and within the third fluid channel 1. Thus, the liquid present within the third fluid channel 1 may reach radially inner positions which cannot be reached during the state of equilibrium. In other words, during emptying of the second fluid channel 3, the dynamics of the emptying process increase, as a result of which higher filling levels are achieved in the first and third fluid channels 2 and 1 than during the state of equilibrium. In embodiments, the third fluid channel may be configured as a siphon, the outlet end of which is arranged radially further outward than is the fluid inlet of the first compression chamber 3 so as to enable all of the liquid to flow off.

Figure 2:
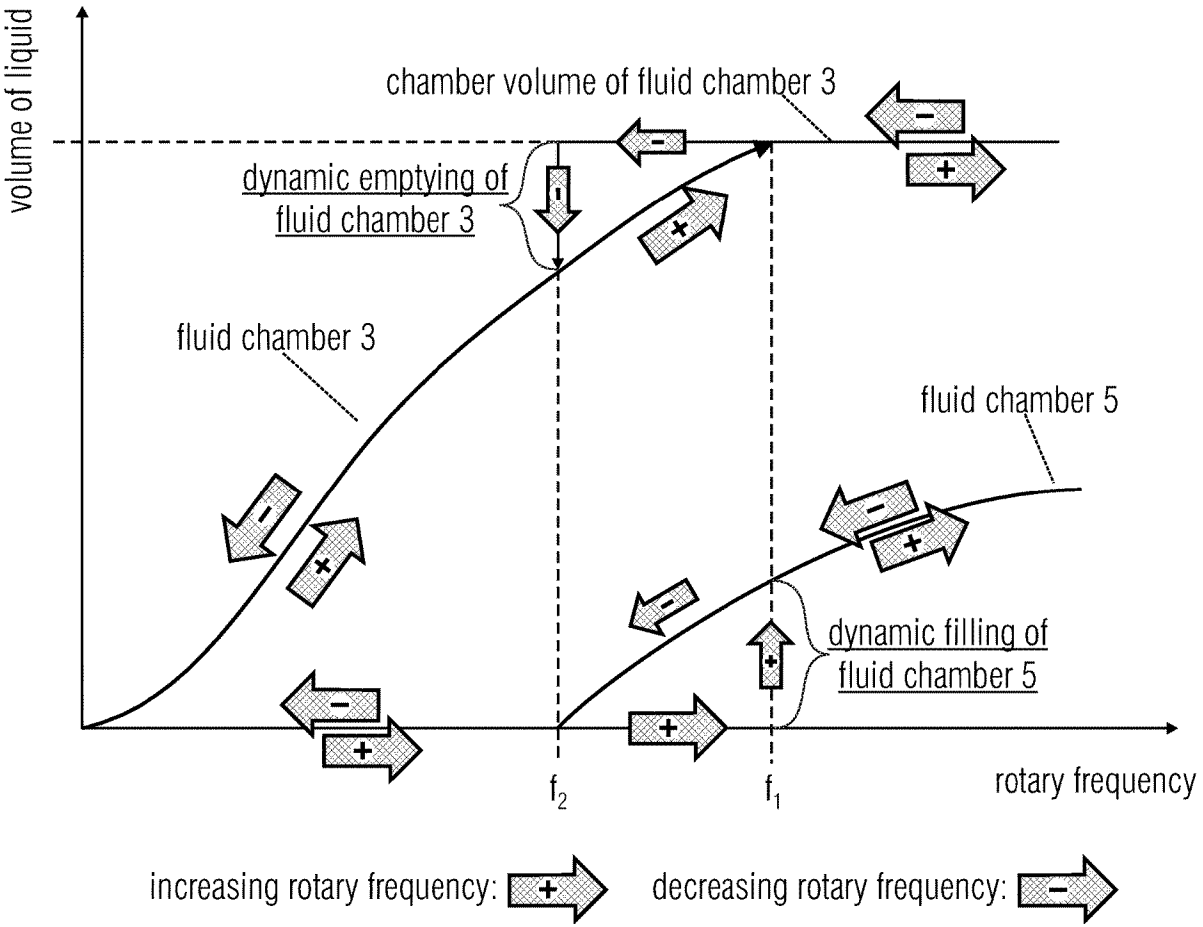
FIG. 2 shows a diagram for illustrating effects underlying the embodiment shown in FIGS. 1A to 1D.

As can be seen from FIG. 2, the volumes of liquid present within the fluid chambers 3 and 5 are subject to hysteresis behavior with regard to the rotary frequency. In the event that the fluid inlet 8 of the fluid chamber is located radially further outward than is the fluid outlet 7 of the fluid chamber 3, given an increasing rotary frequency, which is indicated by + by arrows in FIG. 2, dynamic, "abrupt" filling of the fluid chamber 5 will occur as soon as the rotary frequency $f_1$ is exceeded. Given a decreasing rotary frequency, which is indicated by – by arrows in FIG. 2, dynamic, "abrupt" emptying of the fluid chamber 3 will occur as soon as the rotary frequency $f_2$ is fallen below.

Phase 2b: Emptying Process with Dynamics Due to a Large Flow Resistance

Figure 3:
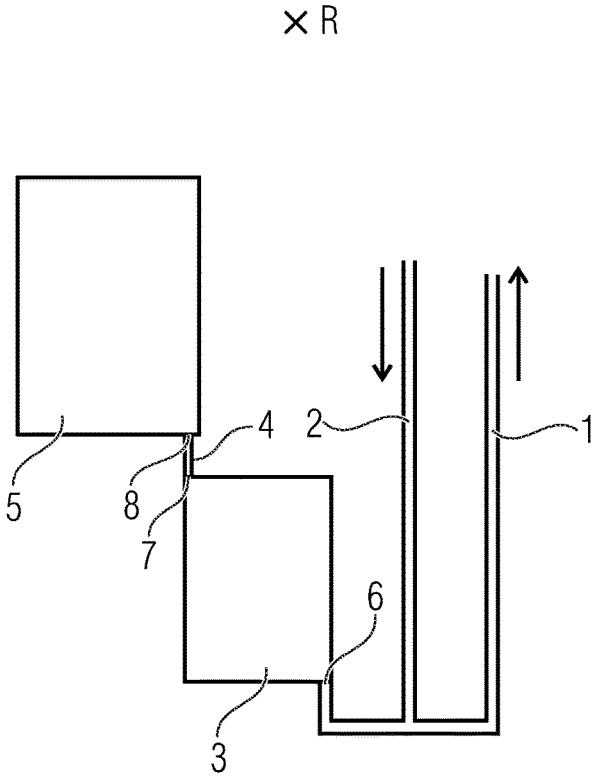
FIG. 3 shows a schematic top view of fluidic structures in accordance with an embodiment of a fluidic module, wherein the second fluid channel comprises a fluid resistance larger than that of the outlet channel.

FIG. 3 shows an alternative embodiment of the invention, wherein the fluid inlet 8 of the second compression chamber 5 is not arranged radially further outward than is the fluid outlet of the first compression chamber. Rather, in the embodiment shown in FIG. 3, the fluid inlet 8 of the second compression chamber 5 is located radially further inward than is the fluid outlet 7 of the first compression chamber 3. It shall be noted that the center of rotation in the figures is above the fluidic structure in each case, as is again indicated in FIG. 3 by the center of rotation designated by the reference numeral R.

In the event that the fluid inlet of the second compression chamber 5 is not located further radially outward than is the fluid outlet of the first compression chamber 3 (cf. FIG. 3), the hysteresis behavior described in phase 2a will not occur: $f_2 \geq f_1$ applies. Rapid, "abrupt" emptying of the compression chamber 3 will nevertheless be achieved if the second fluid channel (connection channel) 4 represents a sufficiently large flow resistance for the liquid. In this case, when the compression chamber 5 is being filled, this filling process will initially be delayed by the large flow resistance present within the connection channel 4. After a sufficiently long filling time the system will reach the state of equilibrium, wherein the liquid filling levels will not change again at a given rotary frequency.

If the rotary frequency is subsequently reduced, flowback of the liquid will be limited by the large flow resistance present within the second fluid channel 4. In the event of a sufficiently large flow resistance within the second fluid channel 4, the flow rate of the liquid during flowback will be so low, even during standstill of the centrifuge rotor, that the liquid filling levels within the fluid channels 1 and 2 will change slightly only. During this flowback process, any rotary frequencies may be applied. In particular, the rotary frequency may clearly fall below the critical value of $f_1$ or even amount to 0. If the rotary frequency f1 is fallen below for a sufficiently long time period, the second compression chamber 5 will initially empty itself, followed by the second fluid channel 4. While the second fluid channel 4 is emptying itself, the flow resistance present within the second fluid channel 4 will decrease (due to the lower viscosity of the compressible medium), so that the flow rate of the liquid will increase during flowback. If the geometries of the fluid channels and of the compression chambers are configured accordingly and if the rotary frequencies are applied accordingly, the flow rate may increase by a sufficient degree during and following emptying of the second fluid channel 4 so as to reach a radially inner position, within the third fluid channel (fluid outlet channel) 1, which cannot be reached during the state of equilibrium.

In embodiments, the large flow resistance and the hysteresis behavior may be combined. The dynamics of the emptying process may be increased or maximized in that a connection channel is configured with a flow resistance larger than that of the outlet channel and in that the fluid inlet of the second compression chamber is arranged radially further outward than is the fluid outlet of the first compression chamber. In this manner, a combination of the above-described effects may be achieved, which makes it possible to pump liquid radially even further inward within the outlet fluid channel.

Figure 4:
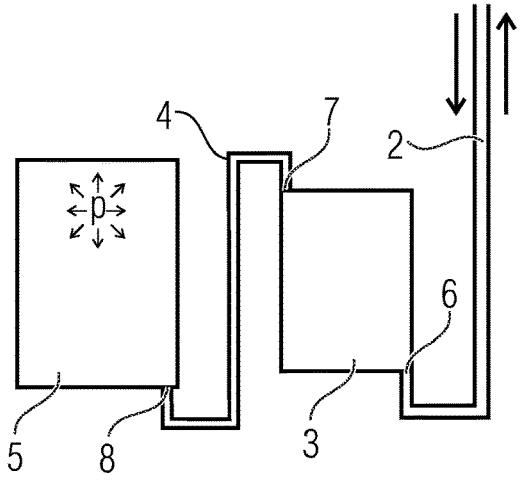
FIG. 4 shows a schematic top view of fluidic structures in accordance with an embodiment of a fluidic module, wherein the first channel forms the outlet channel as well.

FIG. 4 shows a further embodiment of the invention, wherein the fluid inlet channel 2 also represents the fluid outlet channel. The above-described effects may by analogy also be achieved when the fluid inlet channel 2 is also operated as a fluid outlet channel.

Figure 5:
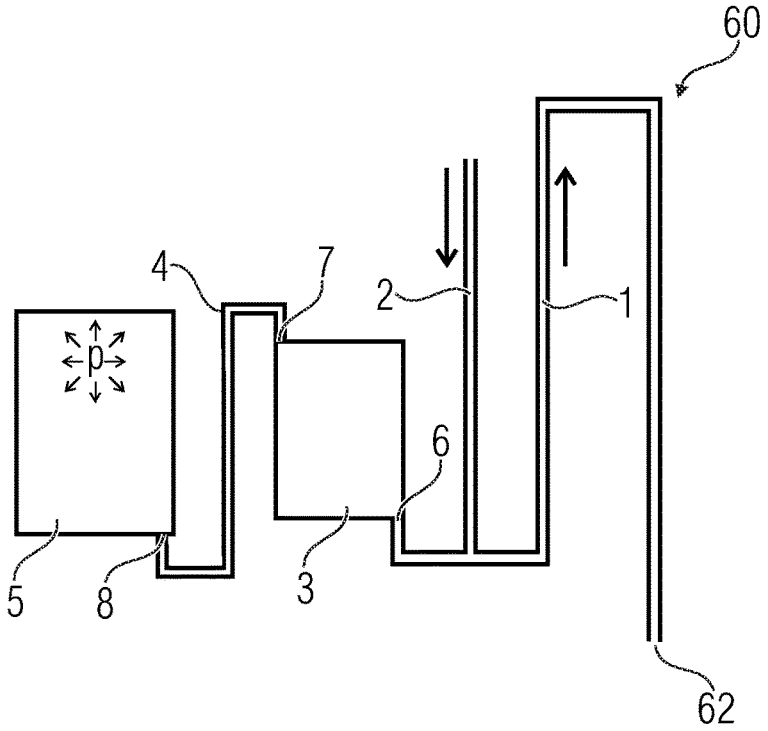
FIG. 5 shows a schematic top view of fluidic structures in accordance with an embodiment of a fluidic module wherein the outlet channel comprises a siphon.

FIG. 5 shows a further embodiment wherein the fluid outlet channel 1 is configured as a siphon 60, so that at least an area, e.g., an outlet end 62 of the fluid outlet channel 1, is located radially further outward than is the fluid inlet 6 of the first compression chamber. In this manner it is possible to empty all of the liquid from the fluidic structure, which comprises the described fluid channels and compression chambers.

In further embodiments, the second compression chamber may be subdivided into several compression chambers connected in series via respective fluid channels. Thus, it is possible for the second compression chamber to again be subdivided into several chambers. As a result it is possible for certain chambers to be filled with the compressible medium exclusively, whereas other chambers are filled with both the compressible medium and the liquid.

In embodiments of the invention, several liquids which are supplied one after the other via the first fluid conduit may be used for the described operation; one or more of the liquids may also be compressible.

In further embodiments, several of the described fluidic structures may be connected in parallel. By means of different channel geometries of the respective second fluid channels (connection channels), sequential switching of the fluids at predefined points in time may then be achieved. This is useful for automating highly diverse biochemical processes.

In embodiments, the outlet channel need not lead into the first compression chamber along with the inlet channel. The outlet channel may also lead into the first compression chamber separately in a radially outer portion, for example the radially outer end, as long as the configuration ensures that the compressible medium within the compression chamber may be compressed. For example, the separate outlet channel may be configured to be closed by the liquid when the first compression chamber is being filled through the first fluid channel.

Exemplary typical values and geometries will now be indicated, it being understood, however, that the present invention is not limited to such values and geometries.

In a typical implementation, the connection channel 4 may comprise a diameter of 20 μm to 200 μm. The volume of the compression chamber 3 may be from 25 to 75 μl, e.g., 50 μl, and the volume of the compression chamber 4 may be from 150 μl to 360 μl. In embodiments of the invention, the volume of the first compression chamber is smaller, e.g. by a factor from 2 to 6, than the volume of the second compression chamber. Typical fluid volumes of the processed liquid may amount to 100 μl, volumes from 100 nl to 5 ml being feasible if the chambers are configured accordingly.

In embodiments of the invention, the outlet channel (including the fluid inlet 6) may comprise a fluidic resistance (flow resistance) which is smaller than the fluidic resistance of the connection channel by at least a factor of 2 or at least a factor of 10. As was described, this is not necessary in every implementation. The viscosity of the processed liquid (e.g., water) may have a viscosity that is higher than that of the compressible medium by a factor from 30 to 90. For example, water as the liquid to be processed has a viscosity that is higher than that of air as the compressible medium by a factor of about 60.

The fluidic structures need not exhibit the shapes indicated. For example, the chambers need not be rectangular but may adopt any shape and may typically have rounded corners.

In embodiments of the invention, the maximum volume of the connection channel may be limited approx. to from 0.3 μl to 0.5 μl. The minimum volume of the first compression chamber in this case should amount to about 5 μl. In principle, the connection channel may also be configured to have a long length, in which case larger channel volumes would also be feasible. However, this would entail technical disadvantages, for example a larger dead volume and a larger amount of manufacturing expenditure.

In embodiments of the invention, dynamic filling and emptying of a compression chamber takes place. Such dynamic filling and emptying may be achieved by the first and second compression chambers connected via the connection channel. By means of this setup, the filling and emptying which may be achieved differ from the dynamic filling and emptying in compression chambers as are known from conventional technology.

In a compression chamber as is known in conventional technology, the equilibrium filling level is steady as a function of the rotary frequency, which means that a very small change in the rotary frequency (e.g., 0.1 Hz) will entail a very small change in the filling level of the compression chamber (e.g. <1%). The equilibrium filling level is defined as that filling level which ensues in the event of a rotary frequency being maintained constant for an infinite amount of time.

In embodiments of the invention, dynamic filling and/or dynamic emptying cannot be achieved with a hysteresis behavior. Due to the geometric arrangement of a chamber system (consisting of at least two compression chambers, or pneumatic chambers), no rotary frequency, for a specific rotary frequency range, may have a defined liquid filling level assigned to it in the equilibrium state, i.e., with centrifugation continuing for an infinite length of time. Depending on whether a chamber system is currently being filled or emptied, a first or a second equilibrium filling level may ensue. If one moves out of said rotary frequency range, a new equilibrium filling level significantly deviating from the current filling level may be strived for. This significant deviation may be compensated for in that the filling and/or emptying process, driven by a centrifugal force or a pneumatic force, is accelerated. With this kind of dynamic filling and/or emptying, the equilibrium filling level as a function of the rotary frequency is unsteady, i.e., a very small change in the rotary frequency (e.g., 0.1 Hz) may result in a significant change in the filling level (e.g., >20%) of the compression chamber.

In embodiments of the invention, dynamic filling and/or dynamic emptying may be achieved by employing large flow resistances. The time curve of the filling and/or emptying process may be decisively determined by channel cross-sections. For example, volume metric flow rates differing from zero may be achieved, due to viscous forces, even at a constant rotary frequency. In particular, the exchange of different media within narrow channels and the viscosity changes associated therewith may result in significant changes in the volume metric flow rate, which changes may accelerate the filling and/or emptying process even at a constant rotary frequency.

Embodiments of the present invention provide a fluidic module that can be rotated about a center of rotation and comprises: a first fluid channel; a first compression chamber fluidically coupled to the first fluid channel; a second compression chamber fluidically coupled to the first compression chamber via a second fluid channel; and a third fluid channel fluidically coupled to the first compression chamber. A liquid can be centrifugally driven into the first compression chamber through the first fluid channel. Upon rotation of the fluidic module, a compressible medium present within the second compression chamber may be entrapped and compressed by a liquid driven into the first compression chamber, into the second fluid channel and into the second compression chamber through the first fluid channel by the centrifugal force. Liquid may be driven out of the second compression chamber and the second fluid channel through the third fluid channel by lowering the rotary frequency and due to the resultant expansion of the compressible medium.

Embodiments of the invention provide a centrifugal-microfluidic structure comprising a compression chamber subdivided into a first part and a second part by a fluid channel, both parts being able, at least in part, to be reversibly filled with a liquid and emptied. During operation, embodiments of the present invention comprise generating highly dynamic fluidic switching processes wherein no rapid changes in the rotational frequency are required. Moreover, embodiments of the present invention comprise, during operation, generating highly dynamic fluidic switching processes wherein neither rapid changes in the rotational frequency nor large fluidic resistances are required. In addition, embodiments of the invention show maintenance of the compression of a compressible medium in a centrifuge rotor over a certain minimum length of time at any given variation of the rotary frequency.

Embodiments of the present invention enable retention of liquids within fluid chambers while any rotary frequency protocol may be applied for a certain amount of time. This enables performing parallel processes during retention of the liquid and, thus, automation of processes more complex than those hitherto known from conventional technology.

In addition, embodiments of the present invention also enable retaining of liquids at a rotary frequency above a defined level, which may clearly be smaller than that rotary frequency which is used for activating retention of the liquid.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A fluidic module which may be rotated about a center of rotation, comprising:

a first compression chamber comprising a fluid inlet and a fluid outlet;

a second compression chamber comprising a fluid inlet;

a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein the outlet channel is a channel separate from the first fluid channel, is the first fluid channel, or comprises part of the first fluid channel and at least one third fluid channel branching off from the first fluid channel, and wherein at least one of the following features is met:

the second fluid channel comprises a flow resistance for the liquid that is larger than that of the outlet channel, and the fluid inlet of the second compression chamber is arranged, in relation to the center of rotation, radially further outward than is the fluid outlet of the first compression chamber.

2. The fluidic module as claimed in claim 1, wherein:

the outlet channel comprises part of the first fluid channel and the at least one third fluid channel branching off from the first fluid channel, and the at least one third fluid channel comprises a flow resistance for the liquid that is lower than that of the first fluid channel.

3. The fluidic module as claimed in claim 1, wherein the outlet channel comprises a siphon, an outlet end of the siphon being arranged radially further outward, in relation to the center of rotation, than is the position where the outlet channel leads into the first compression chamber.

4. The fluidic module as claimed in claim 1, wherein the outlet channel is a fluid channel which is separate from the first fluid channel and which leads into the first compression chamber at a radially outer portion or at the radially outer end thereof.

5. The fluidic module as claimed in claim 1, wherein the fluid outlet of the first compression chamber is arranged at a portion or end, of the first compression chamber, that is arranged radially inward in relation to the center of rotation.

6. The fluidic module as claimed in claim 1, wherein the fluid inlet of the second compression chamber is arranged at a portion or end, of the second compression chamber, that is arranged radially outward in relation to the center of rotation.

7. The fluidic module as claimed in claim 1, wherein the second fluid channel comprises, in the direction of flow from the second compression chamber to the first compression chamber, in relation to the center of rotation, a portion, the beginning of which is further apart from the center of rotation than is its end.

8. A device for handling liquid, comprising:

a fluidic module which may be rotated about a center of rotation, comprising:

a first compression chamber comprising a fluid inlet and a fluid outlet;

a second compression chamber comprising a fluid inlet;

a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein the outlet channel is a channel separate from the first fluid channel, is the first fluid channel, or comprises part of the first fluid channel and at least one third fluid channel branching off from the first fluid channel, and wherein at least one of the following features is met:

the second fluid channel comprises a flow resistance for the liquid that is larger than that of the outlet channel, and the fluid inlet of the second compression chamber is arranged, in relation to the center of rotation, radially further outward than is the fluid outlet of the first compression chamber; and a drive device configured to subject the fluidic module to rotations at different rotary frequencies, the drive device being configured to subject the fluidic module, during a first phase, to a rotation at a rotary frequency at or above a first rotary frequency at which liquid is centrifugally driven through the first fluid channel into the first compression chamber, at which the first compression chamber is filled with the liquid and at which liquid is driven out of the first compression chamber into the second fluid channel and into the second compression chamber so as to thereby entrap and compress the compressible medium within the second compression chamber, the drive device being configured to lower, during a second phase following the first phase, the rotary frequency to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second compression chamber and the second fluid channel into the first compression chamber, out of the first compression chamber into the outlet channel and through said outlet channel.

9. The device as claimed in claim 8, wherein the fluid inlet of the second compression chamber is located, in relation to the center of rotation, radially further outward than is the fluid outlet of the first compression chamber, the second rotary frequency being lower than the first rotary frequency, and wherein the drive device is configured to subject the fluidic module, during an intermediate phase between the first phase and the second phase, to a rotary frequency ranging between the first rotary frequency and the second rotary frequency, without liquid being driven out of the second fluid channel into the first compression chamber.

10. A method of handling liquid, comprising a fluidic module a fluidic module which may be rotated about a center of rotation, said fluidic module comprising:

a first compression chamber comprising a fluid inlet and a fluid outlet;

a second compression chamber comprising a fluid inlet;

a first fluid channel connected to the first compression chamber via the fluid inlet of the first compression chamber; and a second fluid channel connecting the fluid outlet of the first compression chamber to the fluid inlet of the second compression chamber, wherein due to rotation of the fluidic module a liquid may be centrifugally driven into the first compression chamber, into the second fluid channel and into the second compression chamber through the first fluid channel, and thereby a compressible medium may be entrapped and compressed within the second compression chamber, wherein, by lowering the rotary frequency and due to the resultant expansion of the compressible medium, liquid may be driven out of the second compression chamber and of the second fluid channel into the first compression chamber, out of the first compression chamber into an outlet channel and through said outlet channel, wherein the outlet channel is a channel separate from the first fluid channel, is the first fluid channel, or comprises part of the first fluid channel and at least one third fluid channel branching off from the first fluid channel, and wherein at least one of the following features is met:

the second fluid channel comprises a flow resistance for the liquid that is larger than that of the outlet channel, and the fluid inlet of the second compression chamber is arranged, in relation to the center of rotation, radially further outward than is the fluid outlet of the first compression chamber, said method comprising:

during a first phase, rotating the fluidic module with a rotation at a rotary frequency at or above a first rotary frequency so as to centrifugally drive liquid through the first fluid channel into the first compression chamber and into the second compression chamber so as to fill the first compression chamber with the liquid, and to drive liquid from the first compression chamber into the second fluid channel so as to thereby entrap and compress the compressible medium within the second compression chamber, during a second phase following the first phase, lowering the rotary frequency to a value smaller than that of a second rotary frequency at which the force exerted on the liquid by the compressed medium within the second compression chamber outweighs the centrifugal force exerted by the liquid, so that the compressible medium expands and so that consequently, liquid is driven out of the second compression chamber and the second fluid channel into the first compression chamber, out of the first compression chamber into the outlet channel and through said outlet channel.

11. The method as claimed in claim 10, wherein the fluid inlet of the second compression chamber is located, in relation to the center of rotation, radially further outward than is the fluid outlet of the first compression chamber, the second rotary frequency being lower than the first rotary frequency, and which method comprises rotating, during an intermediate phase between the first phase and the second phase, of the fluidic module at a rotary frequency ranging between the first rotary frequency and the second rotary frequency, without liquid being driven out of the second fluid channel into the first compression chamber.

12. The method as claimed in claim 10, which comprises using a fluidic module, the fluid inlet of which is arranged, in relation to the center of rotation, radially further outward than is the fluid outlet of the first compression chamber, wherein during the first phase, when the rotary frequency increases, dynamic filling of the second compression chamber starts as soon as a first rotary frequency $f_1$ is exceeded, and wherein during the second phase, when the rotary frequency decreases, dynamic emptying of the first compression chamber starts as soon as a second rotary frequency $f_2$ is fallen below, wherein $f_2<f_1$.

* * * * *